US010087894B2

(12) United States Patent
Beyer et al.

(10) Patent No.: US 10,087,894 B2
(45) Date of Patent: Oct. 2, 2018

(54) CYLINDER HEAD OF AN INTERNAL COMBUSTION ENGINE

(71) Applicant: Ford Global Technologies, LLC, Dearborn, MI (US)

(72) Inventors: Theodore Beyer, Canton, MI (US); Brian W. Lizotte, Howell, MI (US); Charles Joseph Patanis, South Lyon, MI (US); Philip Damian Cierpial, Grosse Pointe Park, MI (US); Shane Keough, Dexter, MI (US); John Christopher Riegger, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 246 days.

(21) Appl. No.: 15/059,727

(22) Filed: Mar. 3, 2016

(65) Prior Publication Data

US 2017/0254298 A1 Sep. 7, 2017

(51) Int. Cl.

| | |
|---|---|
| ***F02F 1/40*** | (2006.01) |
| ***F02F 1/14*** | (2006.01) |
| ***F02F 1/10*** | (2006.01) |
| ***F02M 26/30*** | (2016.01) |
| ***F02M 26/32*** | (2016.01) |
| ***F02F 1/36*** | (2006.01) |
| ***F02F 1/42*** | (2006.01) |
| *F01P 3/02* | (2006.01) |

(52) U.S. Cl.

CPC ..... *F02M 26/30* (2016.02); *F02F 1/36* (2013.01); *F02F 1/40* (2013.01); *F02F 1/42* (2013.01); *F02M 26/32* (2016.02); *F01P 3/02* (2013.01)

(58) Field of Classification Search

CPC . F02M 26/30; F02M 26/32; F02F 1/36; F02F 1/42; F02F 1/40; F01P 3/02

USPC ..... 123/41.82 R, 41.79, 41.72

See application file for complete search history.

(56) References Cited

U.S. PATENT DOCUMENTS

| | | | | |
|---|---|---|---|---|
| 6,976,683 | B2 | 12/2005 | Eckert et al. | |
| 8,082,894 | B2 | 12/2011 | Pöschl et al. | |
| 8,528,529 | B2 | 9/2013 | Ewen | |
| 8,869,758 | B1 | 10/2014 | Beyer et al. | |
| 8,875,670 | B2 | 11/2014 | Brewer et al. | |
| 2011/0308237 | A1 | 12/2011 | Nagayama | |
| 2013/0055970 | A1 * | 3/2013 | Harada | F01P 3/20 123/41.79 |

(Continued)

*Primary Examiner* — Syed O Hasan

(74) *Attorney, Agent, or Firm* — Brooks Kushman P.C.; Julia Voutyras

(57) ABSTRACT

An engine is provided with a cylinder head having a bridge region surrounded by an exhaust face, an exhaust passage intersecting the exhaust face, and an exhaust gas recirculation (EGR) passage fluidly coupled to the exhaust passage and intersecting the exhaust face. The head defines an upper cooling jacket having a cavity or fluid passage extending from the jacket towards a head deck face and to a closed end wall within the bridge region. The cylinder head is cooled by directing coolant from a lower jacket to an upper jacket via a drill passage adjacent to an exhaust face of the head, diverting the coolant exiting the drill passage into the fluid passage or cavity along a rib. Coolant is then directed from the fluid passage into an EGR cooling passage formed by the upper jacket adjacent to the exhaust face and about the EGR passage.

16 Claims, 4 Drawing Sheets

(56) References Cited

U.S. PATENT DOCUMENTS

| | | | | |
|---|---|---|---|---|
| 2013/0055971 | A1* | 3/2013 | Brewer | F02F 1/24<br>123/41.82 R |
| 2013/0186061 | A1* | 7/2013 | Jarzombek | F01N 5/02<br>60/273 |

* cited by examiner

CYLINDER HEAD OF AN INTERNAL COMBUSTION ENGINE

TECHNICAL FIELD

Various embodiments relate to a cylinder head of an engine and cooling thereof.

BACKGROUND

During engine operation, exhaust gases flow through the head from exhaust valves in the cylinder head to various exhaust systems for the engine. The cylinder head needs to be cooled, and a fluid jacket system containing coolant with a fluid-cooled engine cylinder head design may be provided.

SUMMARY

In an embodiment, an engine component is provided with a cylinder head forming a bridge region bounded by an exhaust passage formed by the head, an exhaust gas recirculation (EGR) passage formed by the head, and an exhaust mounting face. The head defines a cooling jacket having a fluid passage extending from the jacket to a closed end in the bridge region to cool the bridge region, and the passage has an effective diameter less than a length of the passage.

In another embodiment, an engine is provided with a cylinder head having a bridge region surrounded by an exhaust face, an exhaust passage intersecting the exhaust face, and an exhaust gas recirculation (EGR) passage fluidly coupled to the exhaust passage and intersecting the exhaust face. The head defines a cooling jacket having a cavity extending from the jacket towards a head deck face and to a closed end wall within the bridge region.

In yet another embodiment, a method for cooling a cylinder head is provided. Coolant is directed from a lower jacket to an upper jacket via a drill passage adjacent to an exhaust face of the head. Coolant is diverted in the upper jacket from an outlet of the drill passage into a fluid passage along a rib, with the fluid passage provided by a cavity extending from the upper jacket to an end wall within a bridge region bounded by an exhaust passage, an exhaust gas recirculation passage, and the exhaust face, the end wall adjacent to the lower jacket. Coolant is directed from the fluid passage into an EGR cooling passage formed by the upper jacket adjacent to the exhaust face and about the EGR passage.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
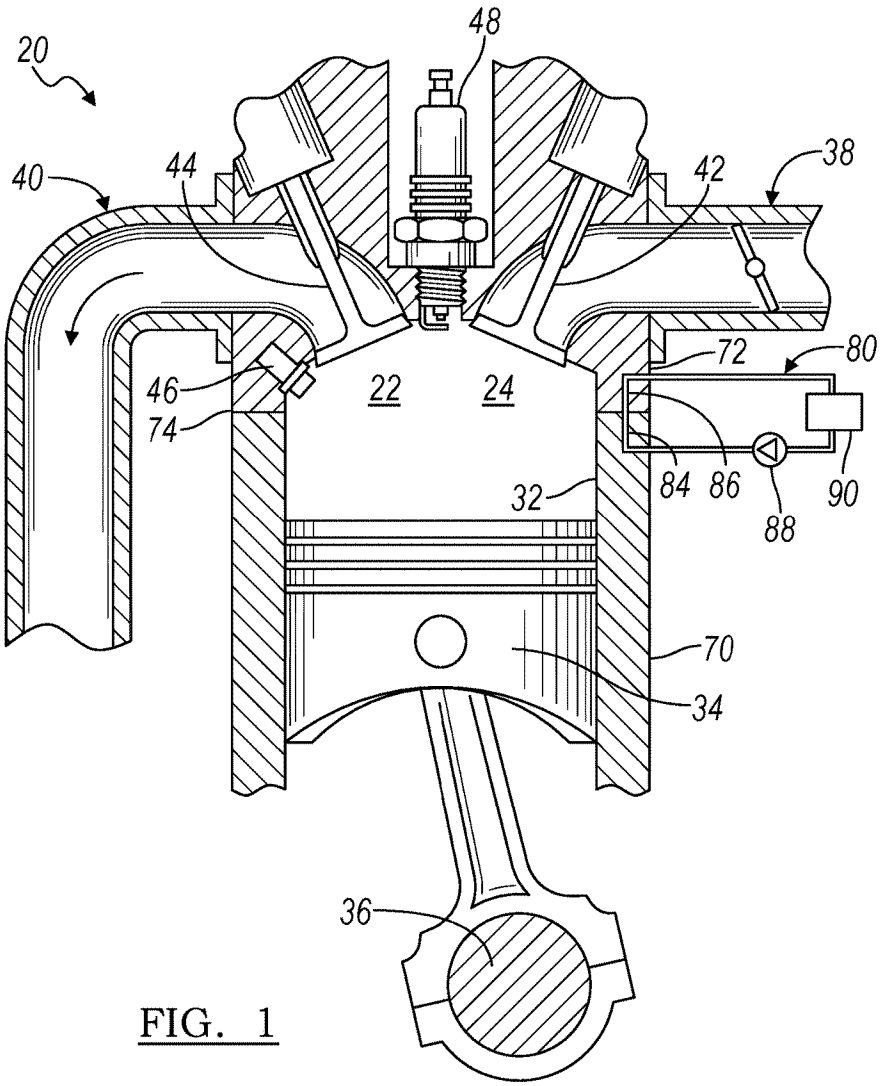
FIG. 1 illustrates an internal combustion engine capable of employing various embodiments of the present disclosure.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust system(s) 40 or exhaust manifold. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust system 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust system 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust system 40 as described below and to an after-treatment system such as a catalytic converter.

The intake and exhaust valve 42, 44 positions and timing, as well as the fuel injection timing and ignition timing may be varied for the various engine strokes.

The engine 20 has a cylinder block 70 and a cylinder head 72 that cooperate with one another to form the combustion chambers 24. A head gasket (not shown) may be positioned between the block 70 and the head 72 to seal the chamber 24. The cylinder block 70 has a block deck face that corresponds with and mates with a head deck face of the cylinder head 72 along part line 74.

The engine 20 includes a fluid system 80. In one example, the fluid system is a cooling system to remove heat from the engine 20. In another example, the fluid system 80 is a lubrication system to lubricate engine components.

For a cooling system 80, the amount of heat removed from the engine 20 may be controlled by a cooling system controller, the engine controller, one or more thermostats, and the like. The system 80 may be integrated into the engine 20 as one or more cooling jackets that are cast, machined, or other formed in the engine. The system 80 has one or more cooling circuits that may contain an ethylene glycol/water antifreeze mixture, another water-based fluid, or another coolant as the working fluid. In one example, the cooling circuit has a first cooling jacket 84 in the cylinder block 70 and a second cooling jacket 86 in the cylinder head 72 with the jackets 84, 86 in fluid communication with each other. In another example, jacket 86 is independently controlled and is separate from jacket 84. The block 70 and the head 72 may have additional cooling jackets. In one example, the head 72 may have a lower cooling jacket substantially positioned between the head deck face and an upper cooling jacket. Coolant in the cooling circuit 80 and jackets 84, 86 flows from an area of high pressure towards an area of lower pressure.

The fluid system 80 has one or more pumps 88. In a cooling system 80, the pump 88 provides fluid in the circuit to fluid passages in the cylinder block 70, and then to the head 72. The cooling system 80 may also include valves or thermostats (not shown) to control the flow or pressure of coolant, or direct coolant within the system 80. The cooling passages in the cylinder block 70 may be adjacent to one or more of the combustion chambers 24 and cylinders 22. Similarly, the cooling passages in the cylinder head 72 may be adjacent to one or more of the combustion chambers 24 and the exhaust ports for the exhaust valves 44. Fluid flows from the cylinder head 72 and out of the engine 20 to a heat exchanger 90 such as a radiator where heat is transferred from the coolant to the environment.

Figure 2:
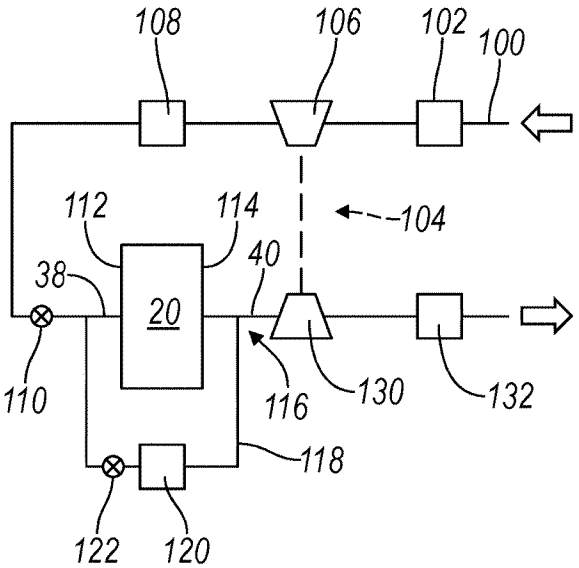
FIG. 2 illustrates a schematic of an exhaust system for the engine of FIG. 1.

FIG. 2 illustrates a schematic of an engine according to an example, and may use the engine 20 as described above with respect to FIG. 1. Intake air enters the intake 38 at inlet 100. The air is then directed through an air filter 102.

In some examples, the engine 20 may be provided with forced induction device such as a turbocharger or a supercharger to increase the pressure of the intake air, and thereby increase the mean effective pressure to increase the engine power output. The engine 20 is illustrated as having a turbocharger 104; however, other examples of the engine 20 are naturally aspirated. The turbocharger 104 may be any suitable turbomachinery device including one or more turbochargers, a supercharger, and the like. The intake air is compressed by the compressor portion 106 of the turbocharger 104, and may then flow through an intercooler 108 or other heat exchanger to reduce the temperature of the intake air after the compression process.

The intake air flow is controlled by a throttle valve 110. The throttle valve 110 may be electronically controlled using an engine control unit, mechanically controlled, or otherwise activated or controlled. The intake air flows through an intake manifold on the intake side 112 of the engine 20. The intake air is then mixed and reacted with fuel to rotate the crankshaft and provide power from the engine 20.

The engine exhaust gases flow from the exhaust valves and ports through exhaust passages in the head and to an exhaust manifold on the exhaust side 114 of the engine 20. In the present example, the head may provide an integrated exhaust with at least a portion of the exhaust manifold incorporated into the engine cylinder head as integrated passages, for example, using a casting process. The exhaust passages intersect an exhaust face of the cylinder head on the exhaust side 114.

A portion of the exhaust gases in the exhaust 40 may be diverted at 116 to enter an exhaust gas recirculation (EGR) loop 118. The EGR gases in the EGR loop 118 may be directed through an EGR cooler 120 or heat exchanger to reduce the temperature of the EGR gases. The temperature of the exhaust gases at 116 may be as high as 1000 degrees Celsius. In the engine 20, the EGR takeoff may be incorporated into the passages in the cylinder head of the engine 20.

The EGR gases in the heat exchanger 120 may be cooled using a fluid in an existing engine system, for example, engine coolant, oil or lubricant, or the like. Alternatively, the EGR cooler may be cooled using environmental air. In further examples, the EGR cooler 120 is part of a standalone system within the vehicle and the EGR gases are cooled by a separate fluid within the system.

A valve 122 may be provided in the EGR system 118 to control the flow of the EGR gases to the intake 38. The valve 122 may be controlled using the engine control unit or another controller in the vehicle. The EGR gases in the loop 118 are mixed within the intake air in the intake 38 for the engine 20. The EGR gases may be cooled to a target temperature or a predetermined temperature for mixing with the intake air. In one example, the EGR gases are cooled to approximately 150 degrees Celsius, although other temperatures are contemplated.

The use of EGR in the engine 20 may provide for reduced emissions from the engine 20 by reducing the peak temperature during combustion, for example, EGR may reduce NOx. EGR may also increase the efficiency of the engine 20, thereby improving fuel economy.

The remaining exhaust gases at 116 that are not diverted for EGR continue through to components of the exhaust system 40. If the engine 20 has a turbocharger, the exhaust gases flow through the turbine portion 130 of the device 104. The device 104 may have a bypass or other control mechanism associated with the compressor 106 and/or the turbine 130 to provide for control over the inlet pressure, the back pressure on the engine, and the mean effective pressure for the engine 20. The exhaust gases are then directed through one or more aftertreatment devices 132. Examples of aftertreatment devices 132 include, but are not limited to, catalytic converters, particulate matter filters, mufflers, and the like.

Figure 3:
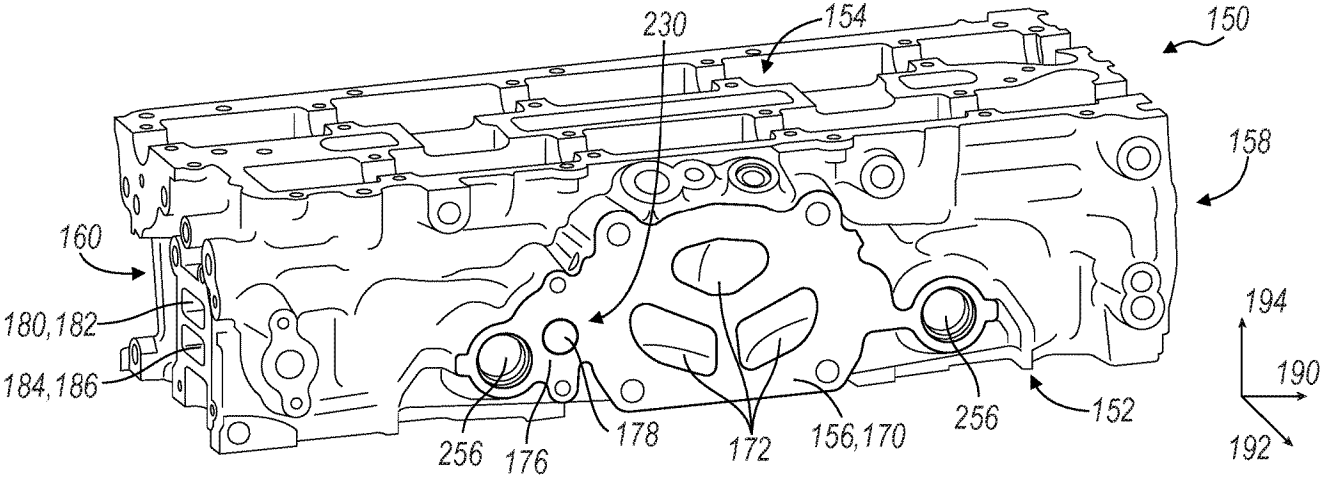
FIG. 3 illustrates a perspective view of a cylinder head according to an embodiment.

FIG. 3 illustrates an engine component such as a cylinder head 150. The cylinder head 150 may be used with the engine 20 as illustrated in FIGS. 1 and 2. The cylinder head 150 as illustrated is configured for use with an in-line, spark ignition, turbocharged engine with exhaust gas recirculation. The cylinder head 150 may be reconfigured for use with other engines, for example a naturally aspirated engine, or engine with other numbers of cylinders, and remain within the spirit and scope of the disclosure. The cylinder head 150 may be formed from a number of materials, including iron and ferrous alloys, aluminum and aluminum alloys, other metal alloys, composite materials, and the like. In one example, the cylinder head 150 is cast from aluminum or an aluminum alloy and uses various dies, sand cores and/or lost cores to provide the various gas and fluid passages within the head. Additionally, passages may be formed within the head via various machining processes, for example, by drilling, after the casting process.

The cylinder head has a deck face 152 or deck side that corresponds with the part line 74 of FIG. 1 and that is configured to mate with a head gasket and the deck face of a corresponding cylinder block to form the engine block. Opposed from the deck face 152 is a top face, side, or surface 154. A first side 156 of the cylinder head provides mounting features for an external exhaust manifold, and corresponds with element 114 in FIG. 2. Another side (not shown) is opposed to the exhaust face 156, provides mounting features for the intake manifold of the engine, and corresponds with element 112. The cylinder head 150 also has first and second opposed ends 158, 160. Although the faces are shown as being generally perpendicular to one another, other orientations are possible, and the faces may be oriented differently relative to one another to form the head 150.

The exhaust side 156 of the head 150 has an exhaust mounting face 170 for an external exhaust manifold or other exhaust conduit to direct exhaust gases to a turbocharger, an aftertreatment device, or the like. In one example, the turbocharger itself is mounted to the mounting face 170. The cylinder head 150 as shown has an integrated exhaust with three exhaust ports 172, although any number of exhaust ports from the head 150 is contemplated.

The exhaust side 156 of the head 150 also has a mounting face 176 for an EGR cooler 120 or a conduit to direct EGR gases to the EGR cooler. The mounting face 176 defines an EGR port 178. The EGR gases are diverted from the exhaust gas stream within the head 150. The mounting faces 170, 176 are illustrated as being co-planar and a continuous surface.

The cylinder head 150 has a fluid jacket formed within and integrated into the head 150, for example, during a casting or molding process. The fluid jacket may be a cooling jacket, as described herein for flow of coolant therethrough.

In the head 150 as shown, there are two cooling jackets within the head 150. An inlet or outlet port 180 is illustrated for an upper cooling jacket 182. An inlet or an outlet port 184 is also illustrated for a lower cooling jacket 186. The cooling jackets 182, 186 may be in fluid communication with one another inside the head 150 as described below. In other examples, the head 150 may only have a single cooling jacket, or may have more than two jackets.

The head 150 has a longitudinal axis 190 that may correspond with the longitudinal axis of the engine, a lateral or transverse axis 192, and a vertical or normal axis 194. The normal axis 194 may or may not be aligned with a gravitational force on the head 150.

Figure 4:
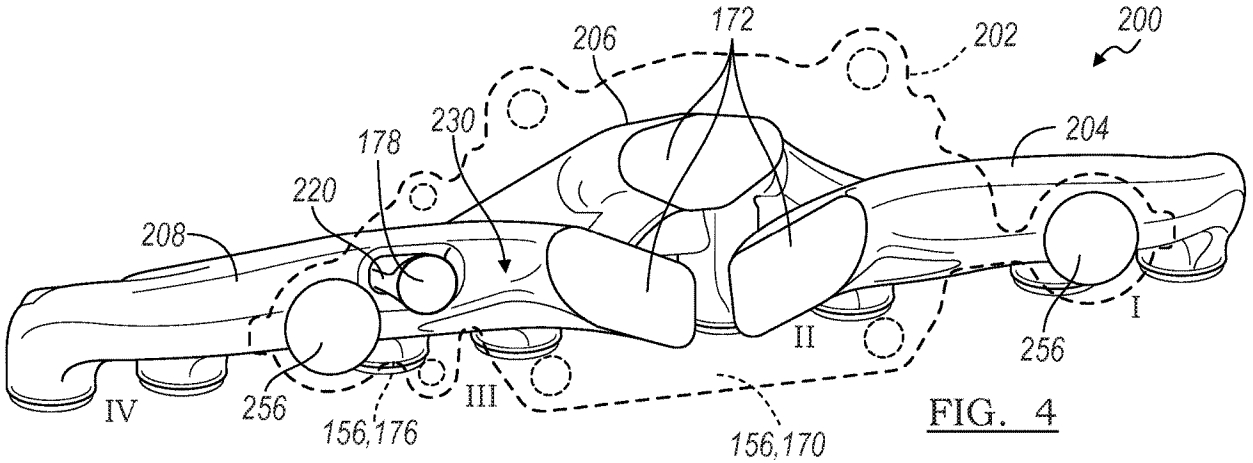
FIG. 4 illustrates a core for the exhaust passages within the cylinder head of FIG. 3.

FIG. 4 illustrates a core 200 for forming the exhaust passages within the head 150. The core 200 represents a negative view of the passages within the head 150, and may represent the shape of a sand core or lost core used in a casting process for the head 150. The core 200 provides an integrated exhaust for the head 150. The dashed line 202 represents the mounting faces 170, 176 for the exhaust and EGR flows.

The core 200 has three exhaust passages 204, 206, 208. As can be seen in the Figure, exhaust gases from one or multiple cylinders may be directed to exhaust passages by runners or sub-passages. Each exhaust passage provides a fluid connection between the respective cylinder and a respective exhaust port on the mounting face 170.

Exhaust passage 204 fluidly connects cylinder I of an engine to the lower right port 172 in FIG. 3, exhaust passage 208 fluidly connects cylinder IV of the engine to the lower left port 172 in FIG. 3, and exhaust passage 206 fluidly connects cylinders II and III of the engine to the upper central port 172 in FIG. 3. Each exhaust passage 204, 206, 208 intersects the mounting face 170 to form the respective exhaust port and is fluidly coupled with at least one respective cylinder for the engine. Exhaust flow within the exhaust passages 204, 206, 208 may be combined within the turbocharger or other exhaust system connected to the mounting face 170. Multiple exhaust passages 204, 206, 208 and associated ports on the mounting face 170 may be provided for pulse separation of the exhaust gases from different cylinders.

An EGR passage 220 is provided within the cylinder head 150 and is fluidly connected or coupled to an exhaust passage, such as passage 208. The EGR passage 220 may be connected or fluidly coupled to an intermediate region of the passage 208, for example, at a location along the passage 208 that is between the in-cylinder exhaust port and the mounting face 170. The EGR passage intersects the mounting face 176 to provide the EGR port 178 on the head 150. The EGR passage 220 directs or diverts a portion of the exhaust gases within the exhaust passage 208 to the EGR port 178 for exhaust gas recirculation. Note that in the present embodiment, the EGR passage 220 only receives exhaust gas from one passage 208 in fluid communication with cylinder IV, and therefore the engine is limited to 25% exhaust gas recirculation for this engine configuration.

A bridge region 230 is formed in the cylinder head 150. The bridge region 230 is formed by the material of the cylinder head 150 that surrounds the exhaust passages. The bridge region 230 is bounded or surrounded by exhaust gas passages and the mounting faces 170, 176. The bridge region 230 is bounded along one side by the mounting faces 170, 176. The bridge region 230 is bounded along another side by the EGR passage 220. The bridge region 230 is bounded along the other side(s) by the exhaust passage 208.

As the bridge region 230 is surrounded by either exhaust passages 208, 220 or components connected to the mounting faces 170, 176, the bridge region 230 may reach high temperatures during engine operation as cooling of the bridge region 230 via the mounting flanges 170, 176 is not possible as the flanges are covered by components and do not provide for heat dissipation or cooling of the bridge region 230. The bridge region 230 is similar to an exhaust valve bridge in that it has exhaust flows on multiple sides heating the region. In one example, exhaust gas may be on the order of 1000 degrees Celsius during engine operation, and a target cylinder head material temperature may be 250 degrees Celsius. Therefore, active cooling of the bridge region 230 is required and is described below according to an embodiment of the disclosure. Without active cooling, the bridge region 230 may overheat due to heat transferred from the exhaust gases, which may lead to an engine shutdown, derating the engine during operation, or thermal failure of the cylinder head 150.

Figure 5:
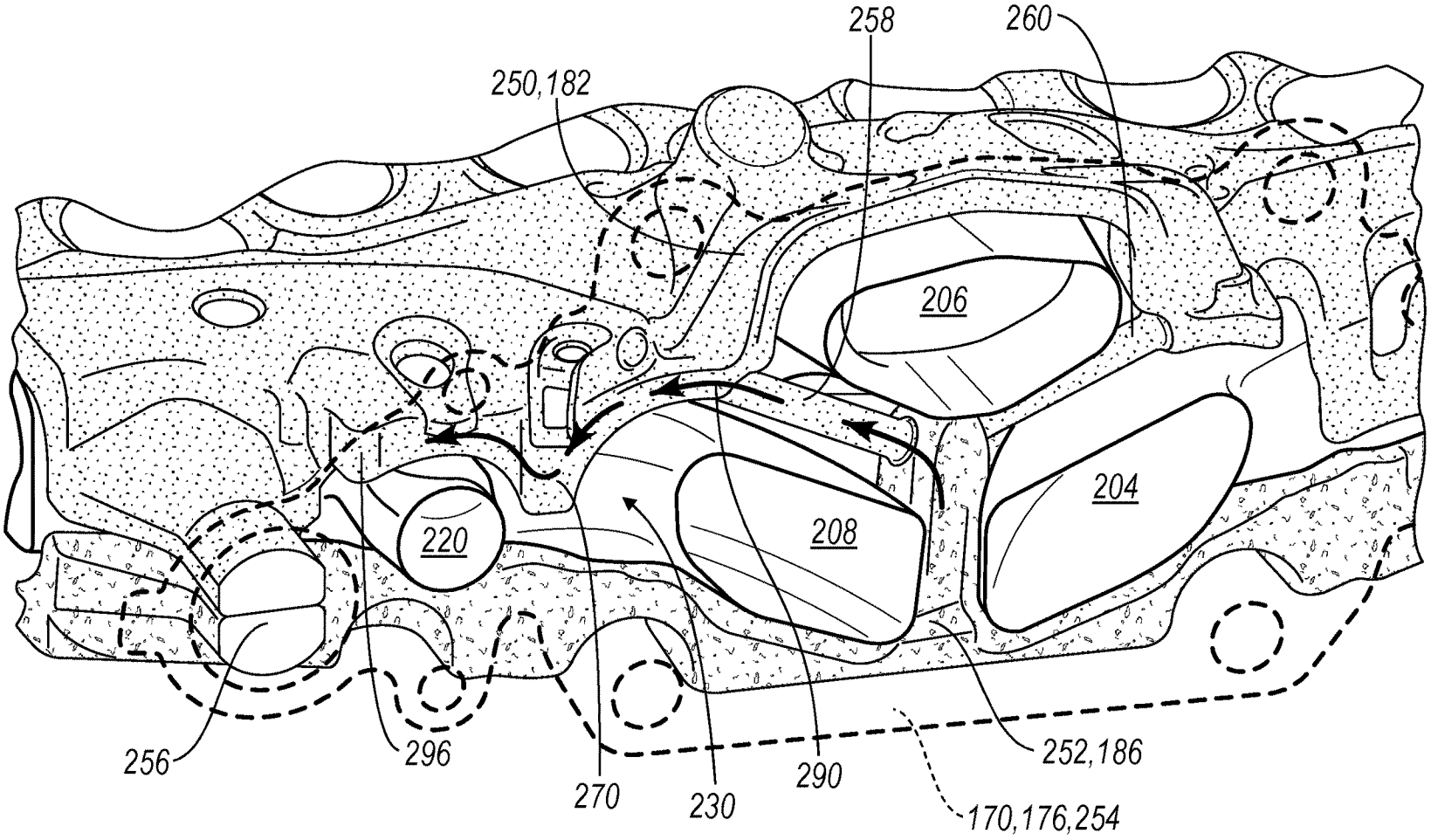
FIG. 5 illustrates partial view of cores for an upper and lower jacket and the core of FIG. 4 for the cylinder head of FIG. 3.
Figure 6:
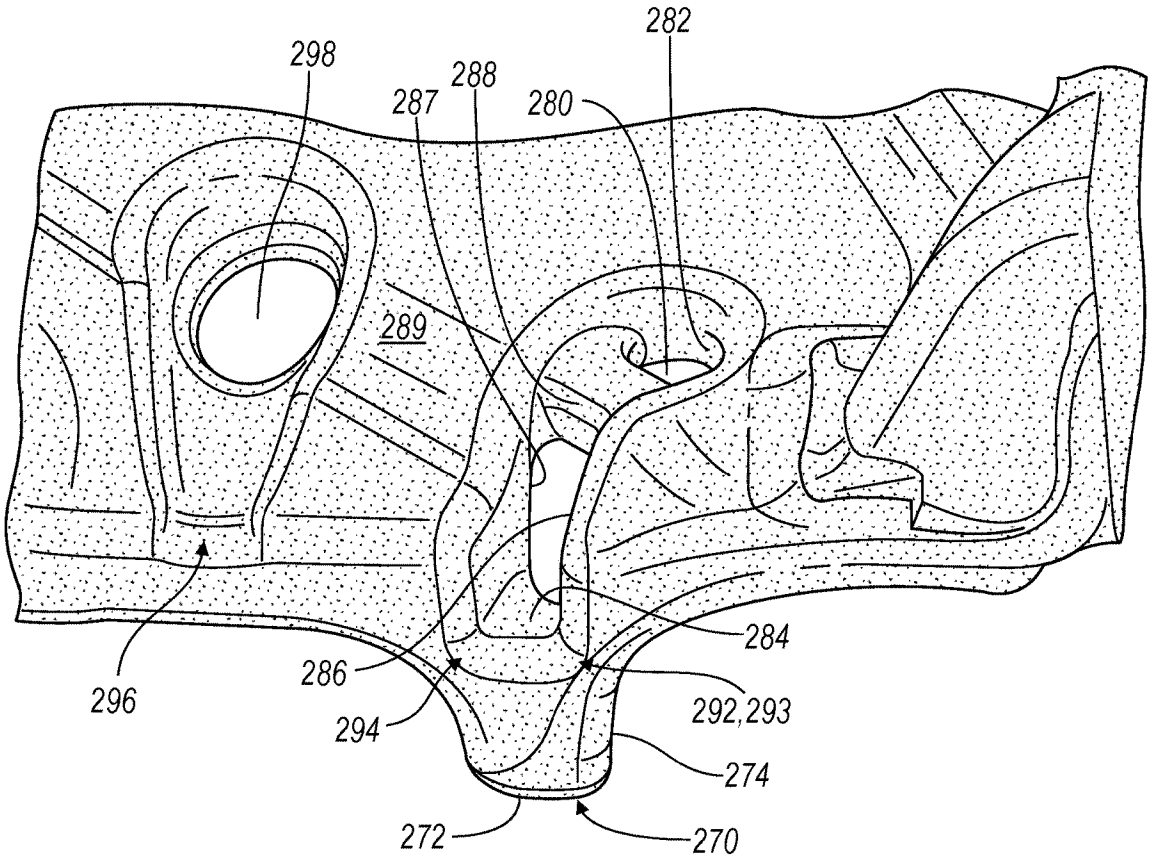
FIG. 6 illustrates a partial view of the core for the upper jacket of FIG. 5.

FIG. 5 illustrates a partial view of the exhaust core 200 of FIG. 4 as well as a first core 250 used to form an upper cooling jacket 182 for the cylinder head and a second core 252 used to form a lower cooling jacket 186 for the cylinder head. FIG. 6 illustrates a partial perspective view of the core 250 used to form the upper cooling jacket 182. The cores 250, 252 represent negative views of the coolant passages within the head 150, and may represent the shape of a sand core or lost core used in a casting process for the head 150. The dashed line 254 represents the location of mounting faces 170, 176 for the exhaust and EGR components. Note that a locator feature 256 is illustrated for the upper core 250, and this feature 256 is used to locate the core during the casting process, and is subsequently plugged in a finished cylinder head 150. For the following description, FIG. 5 will be described in terms of the exhaust passages and cooling jackets 182, 186 and associated fluid passages that are formed within the cylinder head 150 by the various cores.

The lower jacket 186 is positioned between a deck face of the cylinder and the upper jacket 182. The lower jacket is fluidly connected or coupled to the upper jacket via a passage 258. In one example, the passage 258 is a drill passage 258 that is provided during a machining or other post-casting process. The drill passage 258 provides for fluid flow from the higher pressure, lower cooling jacket 186 to the lower pressure, upper cooling jacket 182. The upper jacket 182 is fluidly coupled to receive coolant from the lower jacket 186 via the drill passage 258. The drill passage 258 is positioned alongside and adjacent to the mounting face 170. In one example, the drill passage 258 is spaced apart from the mounting face 170 by a distance of less than two to three diameters of the drill passage. The drill passage 258 is positioned between two of the exhaust passages 206, 208 to aid in cooling the exhaust passages 206, 208 as well as provide the fluid coupling between the jackets 186, 182. Another drill passage 260 may be provided between the exhaust passages 204, 206 as shown for cooling of the exhaust passages and for fluid coupling of the jackets.

The upper jacket 182 has a fluid passage 270 extending from the jacket 182 to a closed end 272 in the bridge region 230 to cool the bridge region. The passage 270 is formed by a finger element of the core 250 used to form the upper jacket 182. The passage 270 may also be referred to as a cavity. The fluid passage 270 extends from the upper jacket 182 towards the head deck face and towards the lower jacket 186. The fluid passage 270 has a continuous side wall 274 that extends to a closed end wall 272 within the bridge region 230. The fluid passage 270 is therefore provided as a blind passage, or a cavity where the only fluid connection is along the upper jacket 182, such that the end wall 272 does not provide for fluid flow into or out of the passage 270. The end wall 272 may be adjacent to and spaced apart from the lower jacket 186. The passage 270 is not connected to the lower jacket 186 to prevent cross-flow between the jackets 182, 186. In one example, the passage 270 has an effective diameter that equal to or less than a length of the passage, where the length of the passage 270 is defined as the distance between the lower surface of the upper jacket adjacent to the passage 270 and the end wall 272. In one example, the end wall 272 extends to a central zone of the bridge region 230 such that the end wall is at or past a center of the EGR passage 220.

A flow deflector or diverter rib 280 is provided within the upper jacket 182. The rib 280 is formed by the material of the head 150 as it is cast about the core 250 and fills in the hole identified as the rib 280. The rib 280 directs, diverts, or deflects coolant flow into the fluid passage 270 to prevent stagnant flow within the fluid passage and cooling of the bridge region 230.

The rib 280 has a first end 282 and a second end 284. The first and second ends 282, 284 are connected by a wall, such as a concave wall section 286 as shown. The concave wall section 286 of the rib 280 is formed by a convex surface of the core 250. An opposed wall 287 of the rib 280 also connects the first and second ends 282, 284, and the wall 287 may be formed from a concave surface of the core 250, a convex surface, or a combination thereof. A crossover passage 288 may be provided via a crossover rib as shown in the core 250. The passage 288 may provide for flow of coolant to the cooling jacket region 289 on the "back side" of the rib 280, or the jacket adjacent to the wall 287, where the rib 280 would otherwise block direct coolant flow from the drill to this region. The passage 288 allows for at least a low or trickle flow of coolant from the drill, across the rib, and to region 289 to prevent a low flow, stagnant flow, or wake flow zone in the region 289, and maintain or increase cooling of exhaust region of the cylinder head adjacent to region 289. The crossover rib 288 may also provide support and structure for the core.

The crossover passage 288 extends through or across the rib 280 and between the sides 286, 287 to divide the rib. The crossover passage 288 may be provided at various locations or angles along the rib 280 to control the amount of flow through the passage 288 and amount of flow to the passage 270. The crossover passage 288 also provides directional control of the flow through the passage 288. In other examples, the rib 280 may be provided with more than one crossover passage or no crossover passages. The rib 280 extends across the jacket such that a perimeter of the rib is surrounded by the upper jacket and the rib 280 is joined with the bulk material of the head 150 along upper and lower surfaces.

The first end 282 of the rib 280 is adjacent to an outlet 290 of the drill passage 258 into the upper jacket 182. The second end 284 of the rib 280 is adjacent to an entrance 292 of the fluid passage 270 in the upper jacket 182 to direct coolant into the fluid passage 270.

The end 284 of the rib 280 may be positioned at the entrance 292 of the fluid passage 270 to divide the entrance into a first portion 293 or first region and a second portion 294 or second region. Coolant flows along the wall 286 of the rib 280 and through the first portion 293 to flow into the fluid passage 270. Based on the high pressure coolant flowing from the drill passage 258 into the upper jacket 182, the fluid forms a higher velocity jet or flow into the passage 270, which then flows down towards the end wall 272. The concave wall 286 is shaped to direct fluid towards and into the passage 270 through the first portion 293. The fluid flow then impacts or circulates in an eddy or swirl adjacent to the end wall 272, and then flows up the fluid passage 270, for example along the other side of the passage, and towards the second portion 294. Coolant leaves the fluid passage 270 via the second portion 294 to the upper jacket 182.

The coolant leaving the fluid passage 270 via the second portion 294 may flow directly to an EGR cooling passage 296 formed by the upper jacket 182. The EGR cooling passage 296 may be formed from a sleeve-shaped passage 296 that is adjacent to the mounting face 176 and wraps around at least a portion of the EGR passage 220. The EGR cooling passage 296 receives fluid from the second portion 294 of the fluid passage 270. Another diverter rib or element 298 may additionally cause fluid flow from the passage 270 to be directed to or flow through the EGR cooling passage 296 before flowing to the remainder of the upper jacket 182.

As the engine operates, exhaust gases flow from the cylinders into the exhaust passages. A portion of the exhaust gases in passage 208 may be diverted into the EGR passage 220. The temperature of the EGR gases may be as high as 1000 degrees Celsius through the EGR passage 220. Heat is transferred from the EGR gases in the passage 220 and the exhaust passage 208 through the material of the bridge region 230 of the cylinder head 150, and to the fluid in the cooling passage 270. The heat may be primarily transferred to the coolant via conduction and convection.

In cooling the cylinder head 150, coolant is provided to at least the lower jacket 186 via a pump for circulation through the coolant system. Coolant is directed from the lower jacket 186 to the upper jacket 182 via the drill passage 258 adjacent to the exhaust face 170, 176 of the head, as the upper jacket 182 is operated at a lower coolant pressure than the lower jacket 186. The coolant is directed in the upper jacket 182 from the outlet 290 of the drill passage 258 along a wall 286 of a rib 280 and into the fluid passage 270 or cavity. The end 284 of the rib 280 is positioned adjacent to the entrance 292 to the fluid passage 270 to divide the fluid passage into the first and second regions 293, 294. The fluid flows along the wall 286 of the rib, through the first region 293 and into the fluid passage 270. The fluid passage 270 or cavity extends from the upper jacket 182 to an end wall 272 within the bridge region 230 with the end wall adjacent to the lower jacket 186.

Coolant is directed by the fluid passage 270 towards the end wall 272. The length of the fluid passage 270 may be greater than an average effective diameter of the passage. The coolant has a flow component that is parallel with the end wall 272 adjacent to the end wall. The coolant impinges on the end wall 272 or circulates or swirls adjacent to the end wall. The coolant then flows away from the end wall 272 in the passage 270, and leaves or exits the fluid passage 270 or cavity via the second region 294 and back to the upper jacket 182. In one example, as shown, coolant flows from the fluid passage 270 into an EGR cooling passage 296 formed by the upper jacket 182, with the EGR cooling passage 196 adjacent to the exhaust face 170, 176 and wrapping about the EGR passage 220 for cooling of the head 150 adjacent to the EGR passage 220.

In some examples, additional features may be provided in the fluid passage 270 to enhance cooling of the bridge region 230 via heat transfer to the fluid in the passage 270. The passage 270 may include a series of surface features on side and/or end walls of the passage 270 to increase the surface area of the passage 270, thereby increasing heat transfer. In various examples, the surface features may be various shapes, or other protrusions, depressions, or other contours to enhance heat transfer and/or to control properties of the coolant flow within the passage 270. The end wall 272 may have a specified shape or surface to enhance swirl or flow circulation of the coolant in the passage. The surface features may be provided as a part of the core 250 such that the features are formed within the head 150 when it is cast, molded, or otherwise formed.

In further examples, one or more layers may be provided within the head 150 to enhance heat transfer from the bridge region 230 to the fluid passage 270. For example, various layers may be provided on the side walls 274 and/or end wall 272 of the fluid passage 270. The layers may be formed from a material with a higher thermal conductivity to provide for enhanced heat transfer between material of the bridge region 230 and the fluid in the cooling passage 270.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine component comprising: a cylinder head forming a bridge region bounded by an exhaust passage formed by the cylinder head, an exhaust gas recirculation passage formed by the cylinder head, and an exhaust mounting face, the cylinder head defining a cooling jacket having a blind fluid passage extending from an entrance at the cooling jacket to a closed end wall in the bridge region to cool the bridge region, the blind fluid passage having an effective diameter less than a length of the blind fluid passage from the entrance to the closed end wall; wherein the cylinder head forms a diverter rib extending across the cooling jacket, the diverter rib having a perimeter surrounded by the cooling jacket, the perimeter defined by first and second wall sections extending between first and second ends of the diverter rib, respectively; and wherein one of the ends of the diverter rib is positioned adjacent to the entrance of the blind fluid passage to divide the entrance into a first portion and a second portion such that the diverter rib directs coolant into the blind fluid passage, wherein the first portion is configured to provide coolant to the blind fluid passage, and the second portion configured to remove coolant from the blind fluid passage.

2. The component of claim 1 wherein the diverter rib is divided by a crossover passage extending therethrough, the crossover passage intersecting the first and second wall sections.

3. The component of claim 1 wherein the cooling jacket is further defined as an upper cooling jacket; wherein the cylinder head defines a lower cooling jacket positioned between the upper cooling jacket and a deck face of the cylinder head; and wherein the upper cooling jacket is fluidly coupled to receive coolant from the lower cooling jacket via a drill passage adjacent to the exhaust mounting face.

4. The component of claim 3 wherein the first wall section of the diverter rib is further defined as a continuous concave wall extending from the first end to the second end, the first wall section being configured to receive and direct coolant from an outlet of the drill passage to the entrance of the blind fluid passage.

5. The component of claim 3 wherein the cylinder head defines the exhaust passage as a first exhaust passage intersecting the exhaust mounting face and fluidly coupled with an exhaust port for a first cylinder; and wherein the cylinder head defines a second exhaust passage intersecting the exhaust mounting face and fluidly coupled with an exhaust port for a second cylinder.

6. The component of claim 5 wherein the drill passage is positioned between the first and second exhaust passages and is fluidly connected to the upper cooling jacket adjacent to an end of the diverter rib.

7. The component of claim 1 wherein the exhaust passage intersects the exhaust mounting face and is fluidly coupled with an exhaust port for a cylinder.

8. The component of claim 7 wherein the exhaust gas recirculation passage intersects the exhaust mounting face and is fluidly coupled to the exhaust passage in an intermediate region between the exhaust mounting face and the exhaust port.

9. The component of claim 1 wherein the cooling jacket forms a sleeve-shaped passage to receive fluid from the blind fluid passage and wraps around at least a portion of the exhaust gas recirculation passage adjacent to the exhaust mounting face.

10. An engine comprising: a cylinder head having a bridge region surrounded by an exhaust face, an exhaust passage intersecting the exhaust face, and an exhaust gas recirculation passage fluidly coupled to the exhaust passage and intersecting the exhaust face, the cylinder head defining a cooling jacket having an elongated blind fluid passage extending from the cooling jacket towards a head deck face and having a closed end wall within the bridge region, the cylinder head having a flow deflector rib extending across the cooling jacket, the deflector rib having a perimeter surrounded by the cooling jacket, the deflector rib having a first end adjacent to an entrance of the elongated blind fluid passage and a concave wall section to direct coolant into the elongated blind fluid passage.

11. The engine of claim 10 wherein the exhaust passage is one of a plurality of exhaust passages intersecting the exhaust face for an integrated exhaust, the engine further comprising: an exhaust system connected to the exhaust face and fluidly coupled with the exhaust passage, and an exhaust gas recirculation cooler connected to the exhaust face and fluidly coupled with the exhaust gas recirculation passage.

12. The engine of claim 11 wherein the exhaust system comprises a turbocharger connected to the exhaust face.

13. The engine of claim 10 wherein the cooling jacket is further defined as an upper cooling jacket; and wherein the cylinder head defines a lower cooling jacket connected to the upper jacket via a drill passage to provide coolant thereto, an outlet of the drill passage adjacent to a second end of the flow deflector rib to direct coolant to the concave wall section, the concave wall section extending between the first and second ends of the flow deflector rib.

14. A method for cooling a cylinder head comprising: directing coolant from a lower jacket to an upper jacket via a drill passage adjacent to an exhaust face of the cylinder head; diverting coolant in the upper jacket from an outlet of the drill passage into a blind fluid passage along a rib, the blind fluid passage provided by an elongated cavity extending from an entrance at the upper jacket to an end wall positioned within a bridge region, the bridge region provided by a region of the cylinder head that is bounded by an exhaust passage, an exhaust gas recirculation passage, and the exhaust face, wherein the end wall of the blind fluid passage is adjacent to the lower jacket, wherein the rib extends across the upper jacket and has a perimeter surrounded by the upper jacket, wherein the rib is positioned adjacent to the entrance of the blind fluid passage to divide the entrance into a first region and a second region, and wherein coolant enters the blind fluid passage via the first region; and directing coolant from the blind fluid passage into an exhaust gas recirculation cooling passage formed by the upper jacket adjacent to the exhaust face and about the exhaust gas recirculation passage, wherein coolant exits the blind fluid passage to the exhaust gas recirculation cooling passage via the second region.

15. The method of claim 14 further comprising flowing coolant within the blind fluid passage such that the coolant has a flow component parallel with and adjacent to the end wall.

16. The method of claim 14 wherein a length of the blind fluid passage between the entrance and the end wall is greater than an effective diameter of the blind fluid passage.

* * * * *